US006553904B1

(12) United States Patent
Goss

(10) Patent No.: US 6,553,904 B1
(45) Date of Patent: Apr. 29, 2003

(54) SELF-TENSIONING SILK SCREEN FRAME

(75) Inventor: Duke Goss, Kirkland, WA (US)

(73) Assignee: Namco, Inc., Kirkland, WA (US)

( * ) Notice: Subject to any disclaimer, the term of this patent is extended or adjusted under 35 U.S.C. 154(b) by 0 days.

(21) Appl. No.: 09/624,641

(22) Filed: Jul. 25, 2000

(51) Int. Cl.[7] ..... B41F 15/34
(52) U.S. Cl. ..... 101/127.1; 101/127; 38/102.4
(58) Field of Search ..... 101/127.1, 127, 101/126; 38/102, 102.4

(56) References Cited

U.S. PATENT DOCUMENTS 2,832,171 A * 4/1958 Batey ..... 38/102.4
D257,041 S * 9/1980 Nielsen et al. ..... D15/66
4,525,909 A * 7/1985 Newman ..... 101/127.1
5,127,176 A * 7/1992 Newman ..... 101/127.1
5,443,003 A * 8/1995 Larson ..... 101/127
5,937,751 A * 8/1999 Newman ..... 101/127.1
6,070,526 A * 6/2000 Larson ..... 101/129

* cited by examiner

*Primary Examiner*—Andrew H. Hirshfeld
*Assistant Examiner*—Kevin D. Williams
(74) *Attorney, Agent, or Firm*—Delbert J. Barnard

(57) ABSTRACT

An improved silk screen frame for tensioning a panel of screen material via the rotation of a pair of screen-tensioning members adapted to grip a flexible strip secured to the edge of the screen material in an off-center position with respect to the axis of rotation of the tensioning member. Rotation of the screen-tensioning members imparts a force which thereby stretches the screen panel material to a taut condition, and places each tensioning member in position to be engaged by a pair of adjacent rotatable finger locks which maintain the screen-tensioning members in their rotated state.

12 Claims, 3 Drawing Sheets

SELF-TENSIONING SILK SCREEN FRAME

TECHNICAL FIELD OF THE INVENTION

The present invention relates to an improved silk screen frame, and more particularly, this invention relates to a retensionable screen frame that permits the user to quickly and easily substitute one screen for another, and properly tension each screen for effective, high-quality printing.

BACKGROUND OF THE INVENTION

Serigraphy, more commonly known as screen printing, is one of the most common and versatile printing processes in use today. Screen printing can be applied to a wide variety of surfaces including paper, cardboard, glass, wood, plastic, posters, bottles, electronic circuits, etc., and to an equally wide variety of shapes.

The screen printing process consists generally of forcing an ink, by pressure applied via a squeegee, through the mesh of a screen stretched on a frame and onto the object to which the desired image is intended to be transferred.

It is generally accepted in the screen-printing trade that the quality of a printed image is directly related to the tension of the printing screen. Particularly when printing detailed designs or multicolored images, it is imperative that the printing screen be secured in a very taut condition in order to ensure that the fine details or multitude of colors are accurately transferred onto the intended object.

Because a particular screen pattern may be in demand for an extended period of time, the printer may desire to store the screen so that the same pattern may be reproduced at some future time without the necessity of replacing the printing screen. Historically, the difficulty with removing and replacing the stretched screen meant that the screen was stored on the frame in a stretched condition. Storing the screen in this manner not only necessitated the need for an inventory of frames, but also increased the problem associated with the deterioration of the image produced by the screen, since screens under tension tend to relax somewhat with time.

Moreover, because the desired image may require the use of a number of different screens, an inventory of screens is needed unless the printer can quickly and easily substitute one screen for another in the particular frame.

To this end, a wide variety of solutions have been formulated and are generally represented throughout the prior art as adjustable tension silk screen frames employing floating bars or tension rollers that may be adjusted in some manner to exert a greater force on the silk screen secured thereto.

SUMMARY OF THE INVENTION

Heretofore invented and disclosed herein is an improved silk screen frame for tensioning a panel of screen material and for providing a means of quickly and easily integrating a screen panel with the frame or removing the panel therefrom.

The improved frame of the present invention employs two rotatable members adapted to grip a longitudinal strip to which is secured the screen panel material. The rotatable members are designed to exert a rotational force on the longitudinal strips in an off-center position relative to the member's axis of rotation. Rotation of the screen tensioning members in turn imparts a force on the attached screen panel material such that the material is stretched in a taut condition for effective use in the printing process. The rotated screen tensioning members are held in their rotated position by a locking mechanism that may be engaged or disengaged with the operator's fingers.

Other objects, advantages, and features of the present invention will be apparent to the reader from the foregoing and the appended claims, and as the ensuing detailed description and discussion of the invention proceeds in conjunction with the accompanying drawings.

BRIEF DESCRIPTION OF THE VARIOUS VIEWS OF THE DRAWINGS

In the drawings, like reference numerals refer to like parts throughout the various views unless indicate otherwise, and wherein.

DETAILED DESCRIPTION OF THE INVENTION

Figure 1:
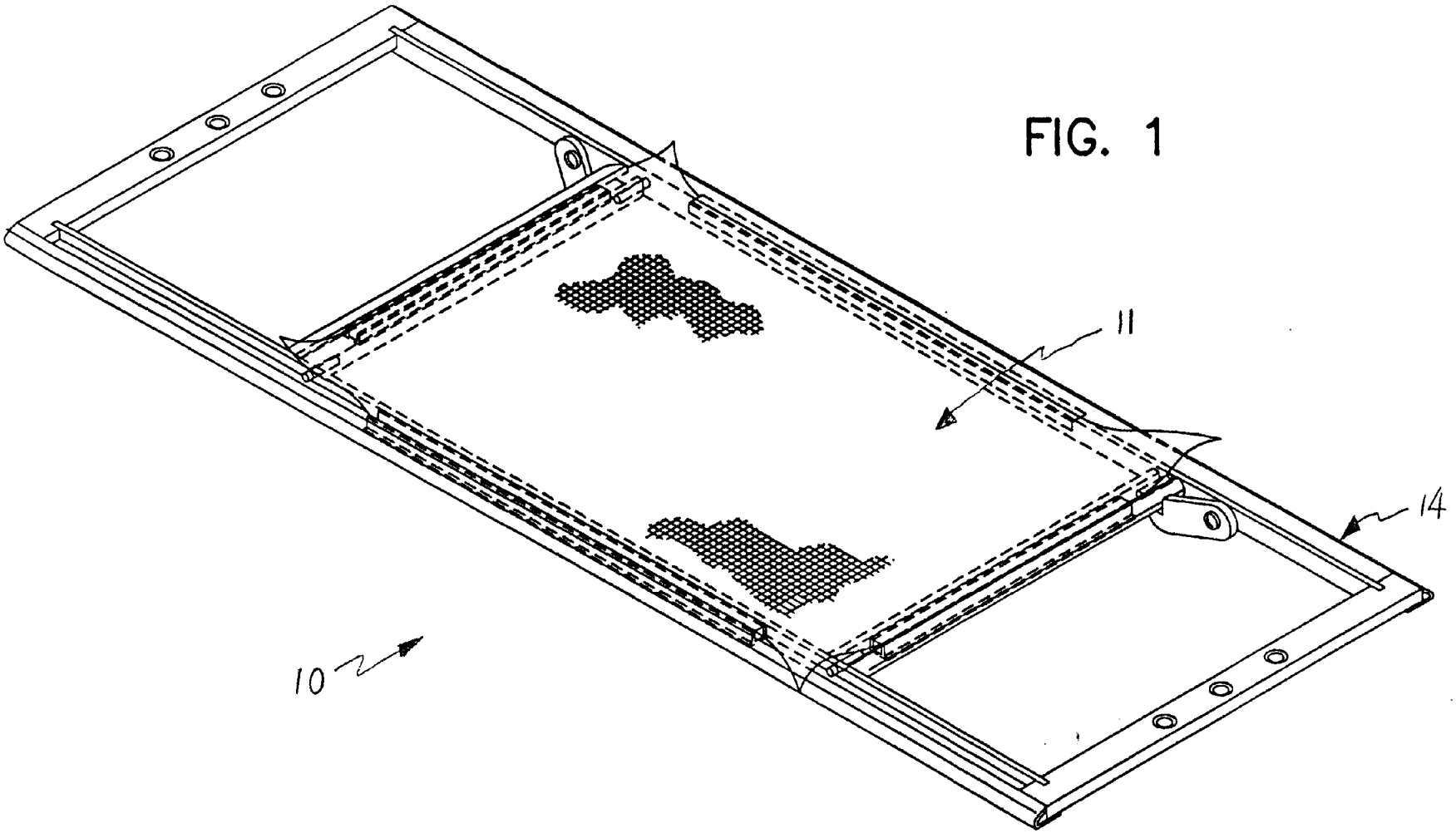
FIG. 1 is a perspective view of a self-tensioning silk screen frame embodying the principles of the present invention, and wherein a silk screen panel is secured to the frame and the screen tensioning members have been rotated and locked into position.

Referring now to the drawings, FIG. 1 depicts a self-tensioning silk screen frame of the present invention with a tensioned silk screen panel affixed thereto generally at 10. The assembled silk screen panel 11 (FIGS. 1 and 2) is adapted to be secured and tensioned by the self-tensioning frame 14 thereby permitting the user to quickly and easily substitute one screen panel for another in the same frame.

Figure 2:
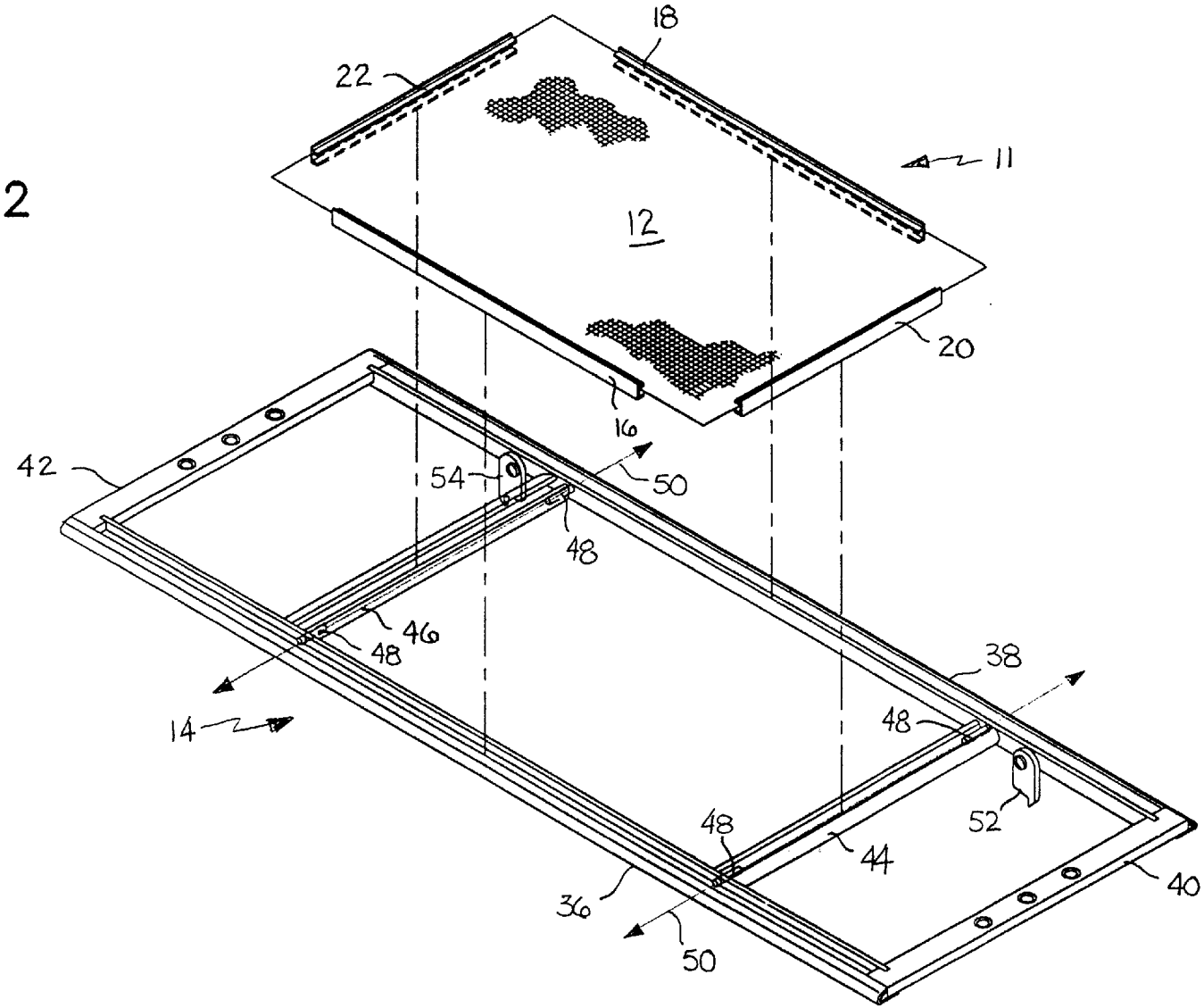
FIG. 2 is a perspective view illustrating the self-tensioning silk screen frame of FIG. 1 and a silkscreen panel adapted to be secured to the frame.
Figure 3:
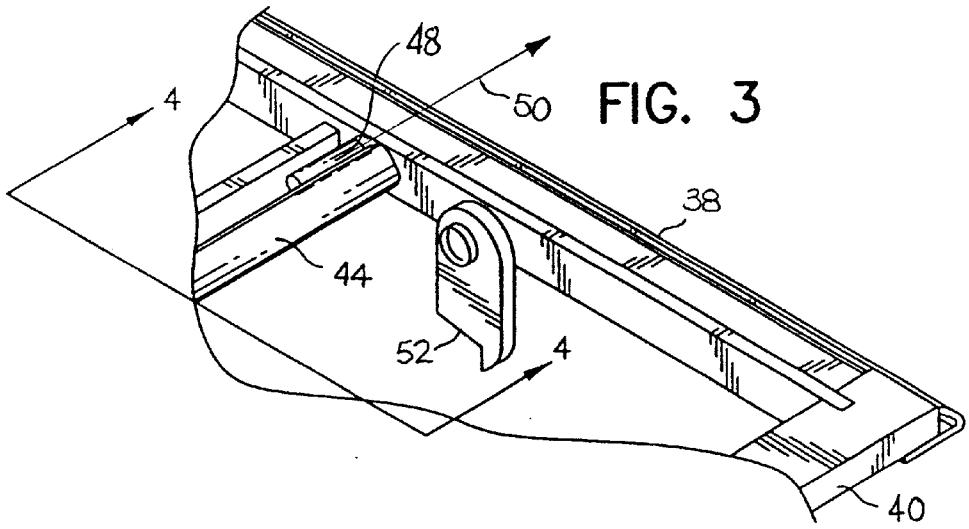
FIG. 3 is a partial, enlarged perspective view of the self-tensioning silk screen frame of FIG. 2.

Referring now primarily to FIGS. 2 and 3, self-tensioning frame 14 is composed of a first longitudinally extending rail 36 and a second longitudinally extending rail 38 interconnected by a pair of end rails 40, 42 affixed at right angles thereto at each end of rails 36, 38. Each end rail 40, 42 may be designed to secure frame 14 to a screen printing machine.

Self-tensioning frame 14 further comprises a pair of screen-tensioning holding members 44, 46 which, along with first and second longitudinally extending rails 36, 38, are adapted to receive longitudinal strips 16, 18, 20 and 22 of assembled silk screen panel 11. Screen-tensioning members 44, 46 are positioned perpendicular to rails 36, 38 and between end rails 40, 42 and are connected to rails 36, 38 via a pin 48 positioned therebetween which permits screen-tensioning members 44, 46 to freely rotate about axis 50 for tensioning the silk screen frame panel material 12. Strips 20, 22 are herein also referred to as end members.

Rotatable lock members, e.g. finger locks 52, 54 are positioned adjacent to screen tensioning members 44, 46 along second longitudinally extending rail 38 such that they may be rotated into a position to engage the respective screen-tensioning member and thereby lock said screen-tensioning member into a position wherein the silk screen panel material 12 is stretched to a taut condition.

A variety of fabric types are available for use in the screen panel 12, each of which will create a different overall impression of the particular print. Organdy and silk are the two most basic fabrics and were traditionally used in this form of printing. Monofilament nylon fabric and polyester are stronger and have replaced the traditional "silk" screen for many contemporary applications of this printing process. In addition, screens made from stainless steel and nickel-plated polyester may be used to achieve a grainier texture in the ink, but are more easily ripped or creased than are the nylon or polyester screens.

The screen panel 11 may be obtained in a pre-assembled form with four longitudinal strips 16, 18, 20, and 22 affixed to the edges of the screen material and adapted for use in the self-tensioning frame 14, or the user may assemble the screen panel individually.

Each longitudinal strip is composed of a three-sided channel member 24, and a block 32 which is adapted to be received in channel member 24 and thereby secure an edge of the silk screen panel 12 to the particular longitudinal strip with which it is associated. The bottom side 26 of channel member 24 extends a particular length beyond a first vertical side 28 of channel member 24 to form extension 34, while remaining flush with a second vertical side 30 (see FIGS. 4 and 5). This configuration is designed to securely fit within the first and second longitudinally extending rails 36, 38 and screen-tensioning members 44, 46 as illustrated in FIGS. 4 and 5.

Having observed the details of the various components of the self-tensioning frame and the adapted silk screen panel assembly, attention may now be given to the placement of the screen panel 11 into the self-tensioning frame 14, and the tensioning of the silk screen panel material 12.

Figure 4:
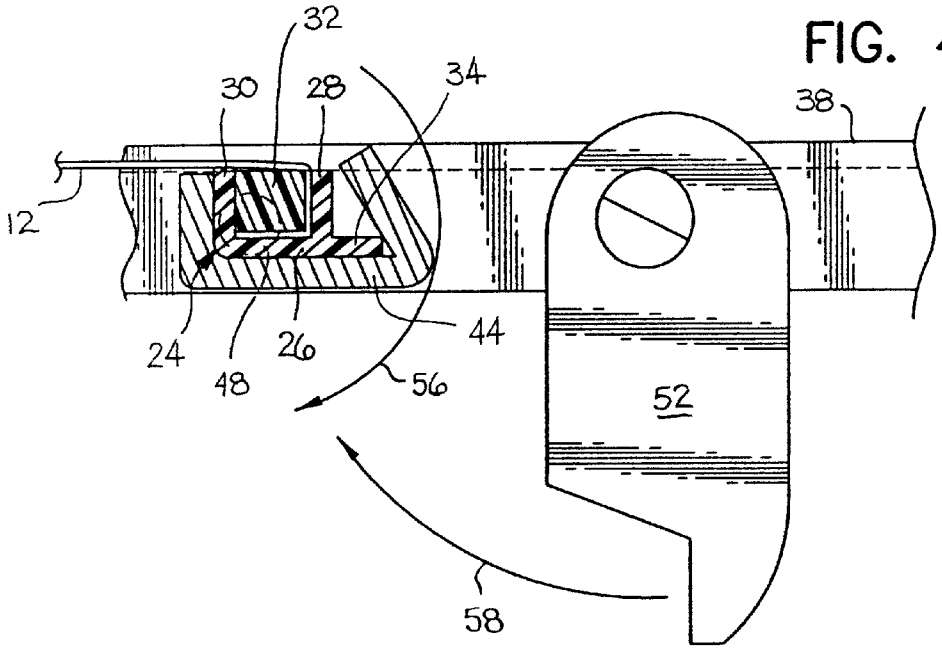
FIG. 4 is an enlarged cross-sectional view of a portion of the self-tensioning silk screen frame taken substantially along lines 4—4 of FIG. 3, illustrating the rotatable screen-tensioning member and the locking mechanism in a disengaged position.
Figure 5:
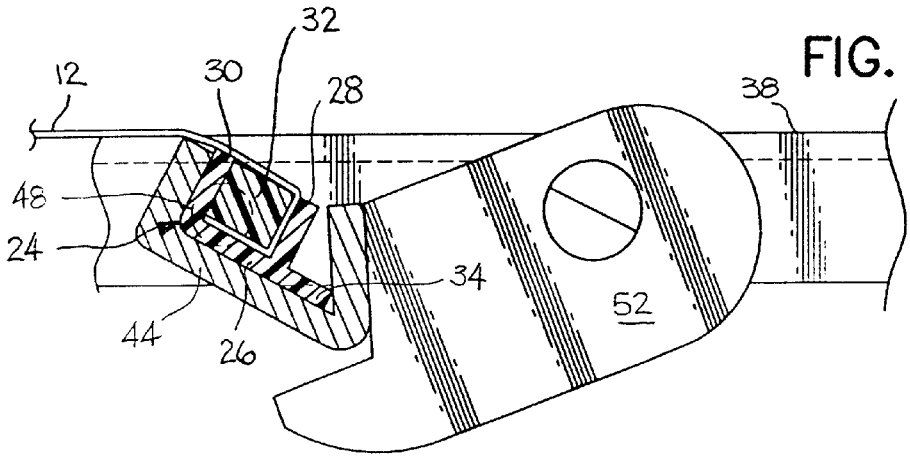
FIG. 5 is an enlarged cross-sectional view like FIG. 4 illustrating an engaged screen-tensioning member and locking mechanism.

Referring now primarily to FIGS. 2, 4, and 5, the assembled silk screen panel 11 may be connected to the self-tensioning frame 14 by first inserting either one of side longitudinal strips 16, 18 into the corresponding first or second longitudinally extending rail 36, 38. Extension 34 is inserted first while the user holds the particular longitudinal strip at an angle. After having placed a first longitudinal strip into an associated longitudinally extending rail, the user then inserts the other strip in the same manner beginning at one end of the corresponding rail and moving toward the opposite end. The longitudinal strips are flexible and will bend as pressure is applied to them so that they may be snapped into place.

The next step in connecting the assemble silk screen panel 11 to frame 14 is similar to that just described, except that screen-tensioning members 44, 46 may be rotated in a direction toward screen panel 11 (opposite from the tensioning direction illustrated by arrow 56 in FIG. 4) in order to more easily insert the corresponding longitudinal strips or end members 20, 22. With these strips in position, screen-tensioning members 44, 46 are then rotated downwardly as indicated by the arrow referenced as numeral 56 in FIG. 4. The off-center position of the pin 48 (illustrated by broken lines in FIGS. 4 and 5), about which each screen-tensioning member rotates, provides increased leverage for tensioning the silk screen panel material 12.

Each screen-tensioning member is rotated to a position, as illustrated in FIG. 5, whereby the corresponding finger lock 52, or 54 can be rotated in an upwardly direction, as indicated by the arrow referenced as numeral 58 in FIG. 4, to engage the screen-tensioning member and thereby hold said member in a tensioned position so that the silk screen panel material 12 remains taut.

Removal of the assembled screen panel 11 from the self-tensioning frame 14 is effected by disengaging the finger locks 52, 54 from screen-tensioning members 44, 46, rotating said members in an upwardly direction opposite that of arrow 56 (see FIG. 4), and removing longitudinal strips 20, 22 therefrom. Finally, either longitudinal strip 16, or 18 may be removed by pushing the strip out of its rail via a specially adapted push tool (not shown) or similar instrument or device which is capable of being inserted through one of a plurality of small holes machined into the underside of each longitudinally extending rail 36, 38. Once one side longitudinal strip has been removed, the other can be easily slipped out of its position.

While the invention is described and illustrated here in the context of a particular embodiment, the invention may be embodied in many forms without departing from the spirit or essential characteristics of the invention. The present embodiment is therefore to be considered in all respects as illustrative and not restrictive. The scope of the invention is indicated by the appended claims rather than by the foregoing description, and all changes which come within the meaning and range of equivalency of the claims are intended to be embraced therein.

What is claimed is:

1. A screen printing device, comprising:

a printing screen; and a tensioning frame for the printing screen;

said tensioning frame comprising first and second side frame members and first and second transverse holding frame members that are connected to and extend between the side frame members;

said printing screen including first and second end edge portions connected to the holding members;

said first holding member having an inner portion that is pivotally connected to the tensioning frame, for pivotal movement about a first pivot axis, and an outer portion that is laterally outwardly of the inner portion;

a transverse connector member connected to the first end edge of the printing screen, said connecter member being detachably connectable to the outer portion of the first holding member;

said first holding member being pivotal in position about said first pivot axis between an up position in which it is generally horizontal and a down position in which it slopes downwardly and outwardly from the first pivot axis;

a lock member having an upper portion that is pivotally connected to the tensioning frame, for pivotal movement about a second pivot axis, and a lower portion that depends from the upper portion and has a lock surface, said lock member having an at-rest position and a lock position; and wherein the connector member at the first end edge of the printing screen is attachable to the outer portion of the first holding member when the first holding member is in its up position, wherein the first holding member can then be swing downwardly from its up position into its down position, and it will carry with it the connector member and pull on the first end edge of the printing screen, causing the printing screen to be tensioned, and wherein the lock member is pivotal inwardly and upwardly from its at-rest position into its lock position in which its lock surface is against the outer portion of the first holding member and are in a position in which it blocks movement of the first holding member from moving from its down position back towards its up position, so as to keep the tension in the printing screen.

2. The device of claim 1, wherein the holding member is in the form of a channel that includes a bottom web, an inner flange projecting upwardly from the bottom web, and an outer flange projecting upwardly from the bottom web, said web and flanges defining a channel space in which the connector member on the first end edge of the printing screen is received.

3. The device of claim 2, wherein the channel space has a top opening and a bottom and the bottom is wider than the top opening.

4. The device of claim 3, wherein the outer flange slopes inwardly as it extends upwardly from the web.

5. The device of claim 1, in which the first and second side frame members of the tensioning frame extend endwise outwardly from the holding frames into end portions, and said tensioning frame includes an end frame member that at each of its ends that extends between and interconnects the end portions of the side frame members.

6. The device of claim 1, wherein said printing screen includes first and second side edge portions connected to the first and second side frame members of the tensioning frame.

7. A screen printing device, comprising:

a printing screen; and a tensioning frame for the printing screen;

said tensioning frame comprising first and second side frame members and first and second transverse holding frame members that are connected to and extend between the side frame members;

said printing screen including first and second end edge portions connected to the holding members;

each said holding member having an inner portion that is pivotally connected to the tensioning frame, for pivotal movement about a first pivot axis, and an outer portion that is laterally outwardly of the inner portion;

transverse connector members connected to the end edges of the printing screen, said connecter members being detachably connectable to the outer portions of the holding members;

each said holding member being pivotal in position about a said first pivot axis between an up position in which it is generally horizontal and a down position in which it slopes downwardly and outwardly from the first pivot axis;

a pair of lock members, one outwardly adjacent each holding member, each lock member having an upper portion that is pivotally connected to the tensioning frame, for pivotal movement about a second pivotal axis, and a lower portion that depends from the upper portion and has a lock surface, each said lock member having an at-rest position and a lock position; and wherein the connector members at the end edge of the printing screen are attachable to the outer portions of the holding members when the holding members are in their up positions, wherein the holding members can then be swung downwardly from their up positions into their down positions, and they will carry with them the connector members, and will pull on the end edges of the printing screen, putting the printing screen in tension, and wherein the lock members are pivotal inwardly and upwardly from their at-rest positions into their lock positions in which their lock surfaces are against the outer portions of the holding members and the lock members block the holding members against moving from their down positions back towards their up positions, so as to keep the printing screen in tension.

8. The device of claim 7, wherein each holding member is in the form of a channel that includes a bottom web, an inner flange projecting upwardly from the bottom web, and an outer flange projecting upwardly from the bottom web, said webs and flanges defining channel spaces in which the connector members in the end edges of the printing screen are received.

9. The device of claim 8, wherein each channel space has a top opening and a bottom and the bottom is wider than the top opening.

10. The device of claim 9, wherein each outer flange slopes inwardly as it extends upwardly from its web.

11. The device of claim 7, in which the first and second side frame members of the tensioning frame extend endwise outwardly from the holding frames into end portions, and said tensioning frame includes an end frame member that at each of its ends that extends between and interconnects the end portions of the side frame members.

12. The device of claim 7, wherein said printing screen includes first and second side edge portions connected to the first and second side frame members of the tensioning frame.

* * * * *